US005520520A

United States Patent [19]

Nakamoto et al.

[11] Patent Number: 5,520,520

[45] Date of Patent: May 28, 1996

[54] PNEUMATICALLY OPERATED DOUBLE ACTING PUMP FOR VISCOUS FOOD STUFFS

[76] Inventors: Tomijiko Nakamoto, 894 Kennedy Road, Scarborough, Ontario, Canada, M1K 2E8; Alberto Nielsen, 151 Sand Road, Holland Landing, Ontario, Canada, L9N 1J2

[21] Appl. No.: 412,781

[22] Filed: Mar. 28, 1995

[51] Int. Cl.[6] ..... F04B 35/00

[52] U.S. Cl. ..... 417/63; 417/397; 285/367; 91/305

[58] Field of Search ..... 417/397, 63; 92/86; 60/455; 285/367; 91/305

[56] References Cited

U.S. PATENT DOCUMENTS

| | | | |
|---|---|---|---|
| 4,026 | 5/1845 | Walther . | |
| 51,686 | 12/1865 | Bloom . | |
| 1,135,476 | 4/1915 | Watts . | |
| 2,093,344 | 2/1935 | Wandel . | |
| 2,548,216 | 4/1951 | Houghton et al. | 285/367 |
| 3,135,210 | 6/1964 | English | 417/397 X |
| 3,450,055 | 6/1969 | England . | |
| 3,776,665 | 12/1973 | Dalton . | |
| 3,811,795 | 5/1974 | Olsen | 417/397 X |
| 3,861,166 | 1/1975 | Goldsberry . | |
| 3,923,428 | 12/1975 | Clark et al. . | |
| 4,087,209 | 5/1978 | Mahig et al. . | |
| 4,730,991 | 3/1988 | Handfield . | |
| 4,824,335 | 4/1989 | Lubitz et al. . | |
| 4,981,418 | 1/1991 | Kingsford et al. | 417/397 X |
| 5,051,074 | 9/1991 | Cowan . | |
| 5,076,769 | 12/1991 | Shao . | |
| 5,094,596 | 3/1992 | Erwin et al. . | |
| 5,324,175 | 6/1994 | Sorenson et al. . | |
| 5,415,531 | 5/1995 | Cavanaugh et al. | 417/397 |

*Primary Examiner*—Richard E. Gluck
*Attorney, Agent, or Firm*—Jane Parsons

[57] ABSTRACT

A double acting pneumatically operated pumping assembly for pumping viscous fluids, especially food stuffs, is provided. The piston has an enlarged central portion integral with reduced diameter end portions. Inspection means, for example vent ports, are provided between seals of each end portion so that any leakage of either pneumatic fluid or of viscous fluid is detectable. The pump is preferably of modular form, each module having flanged ends and hand-tightenable band clamps holding the flanges together for easy assembly and disassembly. A feature of the invention is an operating valve having pilot chambers at each end for control of the spool position. Movement of pilot pistons within the pilot chambers affects the pressure balance between ends of the spool. Changes in pressure may be derived from the piston chamber of the pump from ports located to change the pressure balance of the valve when the pump piston has completed its stroke.

12 Claims, 3 Drawing Sheets

PNEUMATICALLY OPERATED DOUBLE ACTING PUMP FOR VISCOUS FOOD STUFFS

BACKGROUND OF THE INVENTION

1. Field of the Invention

This invention relates to a pneumatically operated double acting pump especially suited for pumping viscous materials more especially viscous materials requiring a high level of hygiene in handling.

2. Description of Prior Art

A variety of pneumatically operated double acting pumps are available having the capability of pumping fluent and viscous liquids. Usually, such pumps have a drive piston reciprocable by means of pneumatic pressure in a drive piston chamber. Piston rods extend from the drive piston in opposite directions and carry pumping pistons in pumping chambers. When the drive piston moves in a first direction a first one of the pumping pistons retreats in the first pumping chamber to suck liquid into this chamber through an upstream non-return valve in a liquid conduit to an from the pumping chamber. During this movement the second one of the pumping pistons advances into the second piston chamber and forces liquid out of it through a downstream non-return valve an a liquid conduit to this second pumping chamber. When the drive piston moves in the other direction liquid is forced from the first pumping chamber and sucked into the second pumping chamber.

Many variables of such pumps are known and exemplary pumps are disclosed in:

| | |
|---|---|
| U.S. Pat. No. 3,450,055<br>To: England | Issued: June 17, 1969 |
| U.S. Pat. No. 3,776,665<br>To: Dalton | Issued: December 4, 1973 |
| U.S. Pat. No. 3,861,166<br>To: Goldsberry | Issued: January 21, 1975 |
| U.S. Pat. No. 4,730,991<br>To: Handfield | issued: March 15, 1988 |
| U.S. Pat. No. 5,094,596<br>To: Erwin | issued: March 10, 1992 |
| U.S. Pat. No. 5,324,175<br>To: Sorenson | issued: June 28, 1994 |

The above listed U.S. patents are exemplary of various double acting pumps. They also show the wide variety of uses to which such pumps may be put.

Pumping of viscous liquids in the food industry is not among potential uses because pumps for viscous liquids are subject to stringent hygiene controls and have provided especial difficulties in design. Any contamination of such product, for example, a food product, is unacceptable and frequently subject to Government regulations. Pumps used for this purpose must be frequently stripped down for cleaning. Replacement of pump parts may be more frequent than is strictly necessary since it is of paramount importance that no contamination reach the product being pumped. Thus seals and valves may be replaced well before the time they may expect to fail.

As a result, pumping food products is an unduly expensive operation due to the time spent in cleaning and servicing pumps and in the cost of installing replacement parts before it may be strictly necessary.

The present inventors have addressed the problem of providing a pump for viscous food products or for other liquids for which hygiene is of prime importance. The inventors have tried to devise a pump which may be cleaned in place, ie. without disassembly, by pumping cleaning fluid through it. They have tried to devise a pump of modular construction for quick and easy assembly and disassembly when necessary. They have also tried to devise a pump in which superfluous part replacement in the interest of avoiding potential contamination is not necessary. Thus they have tried to devise a pump in which it is immediately apparent when a seal fails and, moreover, failure of a seal does not lead to a contamination of a product.

SUMMARY OF THE INVENTION

Accordingly, the invention provides a pneumatically operated double acting pump assembly for pumping viscous fluids, comprising:

a piston having a central cylindrical actuating portion of one diameter integral with first and second cylindrical piston end portions of another diameter, said one diameter being larger than said other diameter;

a piston chamber in which the piston unit is reciprocable under pneumatic pressure, the piston chamber comprising a central actuating chamber accommodating the actuating portion, the central actuating chamber including a stop at either end to limit the stroke of the actuating portion, the piston chamber also including end chambers each opening at a proximal end from the actuation chamber to either side to accommodate the respective first and second cylindrical end portions; and each of the said end chambers opening at a distal end into a respective one of first and second pumping conduits for viscous fluids downstream of a first non-return valve and upstream of a second non-return valve;

a pair of spaced apart seals around each piston end portion to seal with an inner wall of the respective end chamber to prevent leakage of fluid therepast, the seals enclosing an intermediate region between a wall of the portion and a wall of the chamber; and inspection means accessing the intermediate region.

Accordingly the invention also provides a modular pneumatically operated double acting pump assembly for pumping viscous fluids, comprising a first module and four further modules.

The first module comprises a piston unit having a central cylindrical actuating portion of one diameter integral with first and second cylindrical end portions of another diameter, said one diameter being larger than said other diameter; and a piston chamber in which the piston unit is reciprocable under pneumatic pressure, the piston chamber comprising a central actuating chamber accommodating the actuating portion, the central actuating chamber including a stop at either end to limit the stroke of the actuating portion, the piston chamber also having end chambers each continuous with and opening at a proximal end from the actuation chamber to either side to accommodate the respective first and second cylindrical end portions; and each of the said end chambers at a distal end, opening into, at a T-junction, respective open ended first and second cylindrical sections each of which is continuous with and opening into respective ones of first and second pumping conduits for viscous fluids; the piston having a pair of spaced apart seals around each end portion to seal with an inner wall of the respective end chamber to prevent leakage of fluid therepast, the seals enclosing an intermediate region between a wall of the portion and a wall of the chamber.

The four further modules, may each comprise a further section of pumping conduit having said similar conduit diameter to that of said first and second cylindrical sections and each further module is connected for liquid flow therethrough to an end of one of said first and second sections whereby inner walls of two of said further modules and said first section are smoothly continuous and inner walls of another two of said further modules and said second section are continuous; and each of said further modules including non-return valves for flow of liquid in one direction.

Adjacent ends of the first or second sections and the further sections may have flanges so that further sections may be joined together by means of hand tightened clamps.

Although the pump is a double acting pump having two pumping conduits, it will be appreciated that liquid to be pumped often is drawn from a single source and is to be directed to a single destination. In this case, it is necessary to divide a single initial conduit for liquid flow into the two pumping conduits utilized by the pump. Modular division conduit sections and conduit lengths may be provided all having similar diameters so that they may be joined to have smooth continuous inner walls.

The provision of two seals is a reasonably common precaution in various technologies. In this case, however, the provision of inspection means between the seals may allow quick identification of any problem where either pumped product leaks past one seal or actual fluid leaks past the other seal. Each of the seals may itself be a double seal.

The invention also includes a pneumatically operated double acting pump assembly having a piston reciprocable in a piston chamber by means of a reciprocable spool valve, the piston chamber having one port at one end to receive/exhaust pressure and a another port at another end to exhaust/receive pressure;

and first and second control ports; the reciprocable spool valve having a spool reciprocable in a valve chamber between a first position to deliver pressure to said one port and exhaust pressure from said other port and a second position to deliver pressure to said other port and exhaust pressure from said one port; and first and second pilot chambers communicating respectively with ends of the valve chambers first and second pilot pistons, the first pilot piston being reciprocable in the first pilot chamber between a first pilot position and a second pilot position and the second pilot piston being reciprocable in the second pilot chamber between another first pilot position and another second pilot position by receipt/exhaust of pressure from one of said first and second control ports;

each piston in its first pilot position acting to deliver/exhaust pressure to/from one of the ends of the valve chamber;

the first and second control ports being located in the piston chamber to deliver pressure to the first and second pilot chambers whereby the first pilot piston is in its first pilot position when the second pilot piston is in its second pilot position and vice versa.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
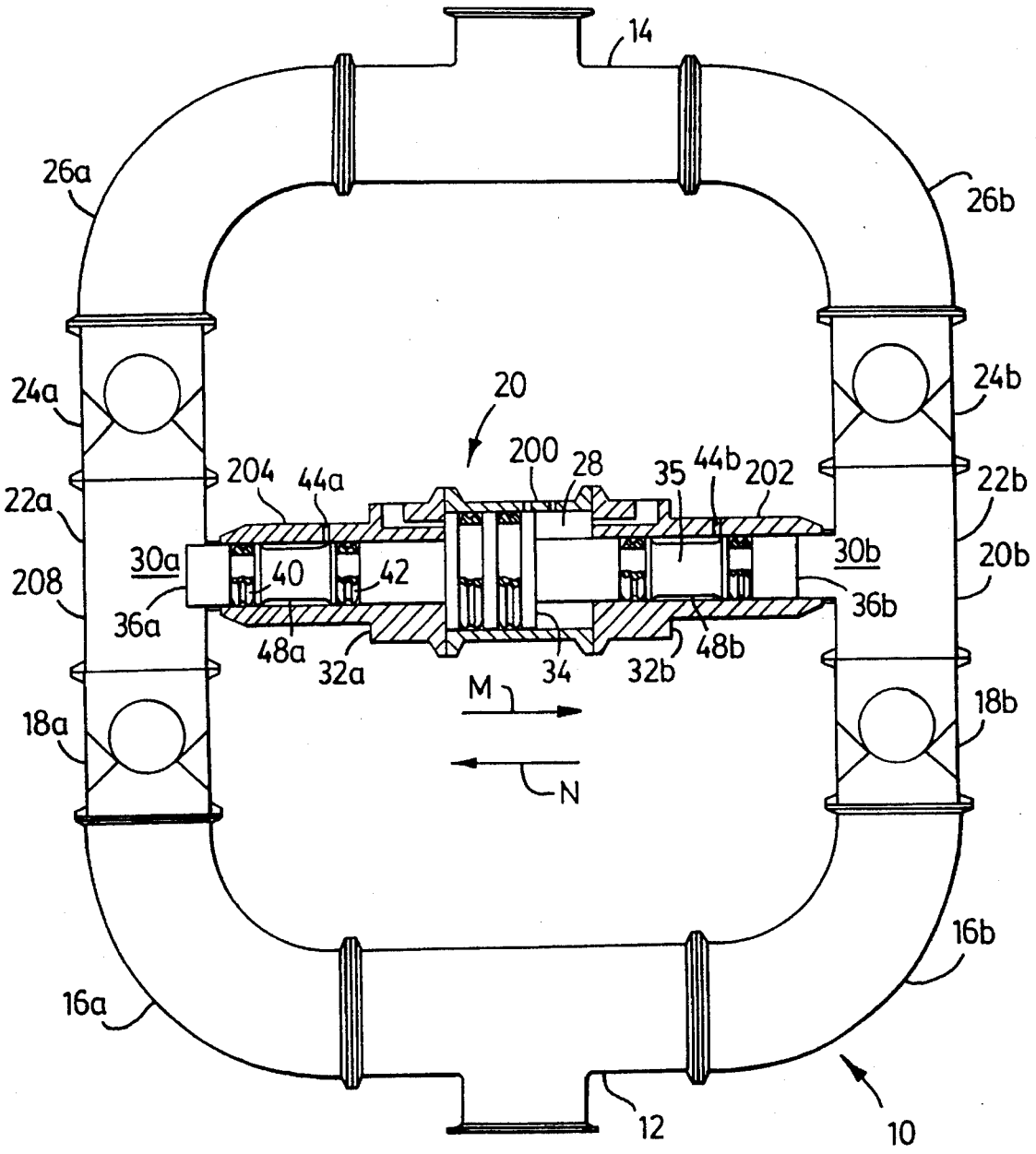
FIG. 1 is a schematic representation of a pump assembly of the invention.

FIG. 1 is a schematic representation of the pumping assembly 10 according to the invention. The assembly 10 includes an inlet module 12 dividing inflow of liquid to be pumped into two streams, which after pumping are reassembled into a single stream by outlet module 14. The inlet module 12 comprises a T-junction, the leg of which accepts incoming flow of viscous liquids and the arms of which direct two separate streams of viscous liquid for pumping. The outlet module 14 is a similar T-junction in which the arms of the T accept the two streams of pumped liquid and the leg of the T directs pumped liquid onward as a single stream.

Liquid issuing from each arm of T-junction 12 passes respectively through conduit module **16*a*, 16*b* a non-return valve module 18*a*, 18*b* an end portion 22*a*, 22*b* of pumping module 20, a further non-return valve 24*a*, 24*b* and a further conduit section 26 connecting with an arm of outlet portion 14. Each of the modules 12, 14, 16, 18, 24 and 26 is of similar internal diameter and joins smoothly with adjacent modules to each side so that each divisional conduit leading from an arm of inlet module 12 to a respective arm of outlet module 14** has a continuous, smooth inner wall not conducive to trapping solid particles of the viscous liquid in any cracks or crevices, indeed, every effort is made to ensure the absence of such cracks or crevices.

End portions **22*a*, 22*b* of pumping module 20 comprise the aligned arms of T-shaped end portions of pumping module 20** which extends between the divided streams of viscous liquid.

Figure 2:
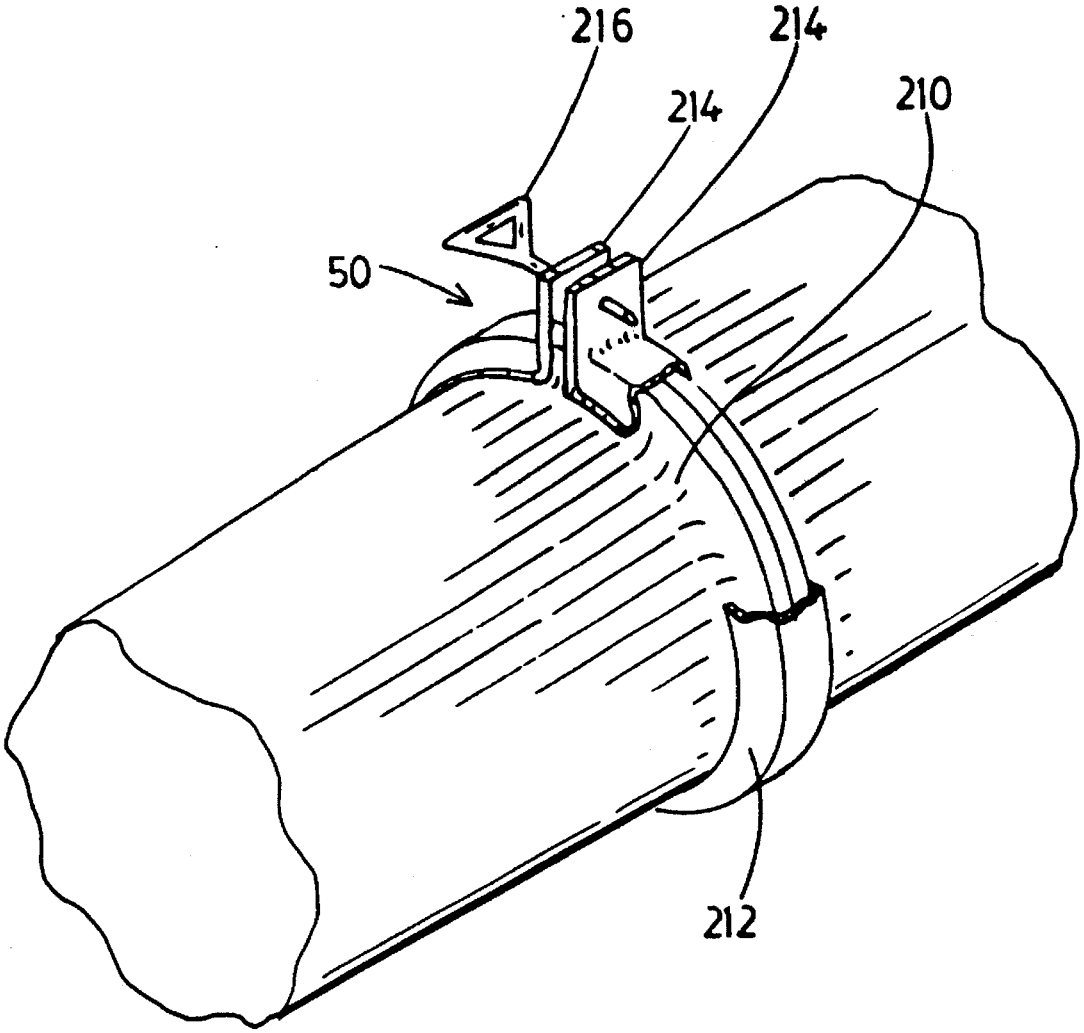
FIG. 2 shows a band clamp clamping two adjacent modules of the assembly of FIG. 1.

Pumping module 20 has a central cylindrical actuating chamber 28 clamped to first and second cylindrical end chambers 30 though hand tightenable clamps 50 shown in more detail in FIG. 2. The diameter of central cylindrical actuating chamber 28 is greater than the diameter of similar symmetrical cylindrical end chambers 30. The central cylindrical actuating chamber 28 connects with the end chambers 30 through annular end walls 32 which form limiting stops for pneumatically actuated piston 34.

End portions 36 to be either side of enlarged portion 34 and slide in end chamber 30. End chamber 30 is arranged at right angles to the straight line conduit formed by respective valve modules **18*a*, 24*a* and 18*b*, 24*b* and the T-junction end portion 22 of end chamber 30 which is at right angles to the body of end chamber 30**.

In operation, as enlarged portion 34 of the piston is forced in the direction of arrow M any viscous liquid in end chamber **22*b* is forced through non-return valve 24*b* towards outlet T conduit 14. Moreover, as the piston moves in the direction of arrow M is sucked through non-return valve 18*a* into end chamber 22*a*. When the piston moves in the opposite direction, ie. in the direction of arrow N, liquid in chamber 22*a* is forced through non-return valve 24*a* towards outlet T conduit 14 and liquid from conduit 16*b* is sucked through non-return valve 18*b* into end chamber 22*b***.

All the modules of the pump so far described fit together in such a manner that the inner walls of the resulting flow channels for viscous liquid are as smooth as possible and as free as possible from sharp corners, nooks, crevices and crannies for easy cleaning of the pump. Moreover, the section of the pump are supplied in easily replaceable modules. Thus, if one of the non-return valves, for example non-return valve **24*a***, should fail or need to be replaced for some other reason, it is a simple matter to replace the module quickly and easily.

For even easier assembly and disassembly the pumping modules may be formed of several submodules, submodule 200 comprising the enlarged diameter portion, submodules 202, 204 comprising the end chambers and submodules 206, 208 comprising the T-junctions.

As shown in FIG. 2 the modules and submodules each have a radial outwardly extending flange 210 at each end. Adjacent flanges abut one another and are held together by a band clamp 212. Each band clamp 212 comprises a length of U-section metal, eg. stainless steel bent into the shape of a circle with the legs of the U directed upwardly to grip the flanges 210. Lugs 214 are provided at the ends of each clamp 212 and a hand tightenable bolt 216 is screw threadidly engaged in screw threaded apertures of said lugs. The clamp 212 may be removed entirely by removing the bolt 216 or may be tightened by screwing it into the apertures.

An important feature of the present invention concerns the provision of the pumping unit itself as an easily replaceable module and the provision of means to avoid contamination of the liquid being pumped by any other fluids. Moreover, inspection means are provided whereby any leakage of pumping fluid or of pumped fluid may be detected immediately should such leakage occur. Each end portion 36 of the piston is provided with a pair of seals 40, 42 which are spaced apart along the piston end portion 36 and act between the piston end portion 36 and the inner wall of respective end chamber 30. The seal 40 is located to prevent leakage of viscous liquid being pumped between the piston end portion 36 and the inner wall of end chamber 30. Seal 40 itself may itself be a double seal at least one member of which is at least approximately at the distal end of piston end portion 36 so that no crack or crevice is initially available between the end of piston end portion 36 and the inner wall of end chamber 30 for penetration by viscous fluid. The other seal 42 is spaced from the seal 40 towards the proximal end of piston end portion 36 to prevent a pneumatic fluid from leaking between the wall of end chamber 30 towards the viscous liquid being pumped.

Between the seals 40, 42 in the wall of end chamber 30, an inspection port 44 or open window is provided so that any leakage of either viscous pumped fluid or pneumatic pumping fluid will either be visible through the inspection port or will actually leak out therefrom. Thus, unless seals 40 and 42 both fail at identical moments, an indication of failure of one of the seals will be obtainable before there have has been any contamination of the pumped fluid. When such failure occurs it may be an easy matter to quickly replace the pumping module. Conveniently, the end portion 36 of the piston may be indented between the seals 40, 42 to provide an actual chamber 48 around the end portion 36 between the seals. Such chamber 48 may fill with liquid in the event of seal failure providing easily visible indication of any such failure.

Pneumatically actuated piston 35 comprises an enlarged central portion 34 sliding within central cylindrical actuating chamber 28 between stops 32. The actual length of the enlarged central portion 34 is less than the length of the piston chamber 28 so that the large central portion 34 may reciprocate therein. Reciprocation is actuated by pneumatic pressure provided by any convenient means to one side of enlarged portion 34 and then to the other side of enlarged portion 34. Conveniently, however, the pneumatic pressure is provided by means of valve 100 which is described in more detail in reference to FIG. 3.

Valve 100 comprises a valve spool 102 reciprocable in valve chamber 104 which is connected to a supply of compressed air through port A.

The body of valve spool 102 has a smaller circumference than the inner circumference of valve chamber 104 and is held clear of the walls of valve chamber 104 by means of seals 108 arranged about the body of the valve spool 102 and slidable in the valve chamber 104. Thus, the valve chamber 104 is divided into compartments about the valve body 102 by the rings 108. The compartments 110, 112, 114, 116 are sufficiently large to provide for air flow about the body of the valve spool 102. At each end of valve chamber 104, narrowed passages 118, 120 lead to extension valve chambers 122, 124 containing respective valve discs 126, 128. Each of the valve discs 126, 128 has a stem 130, 132 extending into the respective narrow passage 118, 120.

In operation, compressed air enters compartment 112 at port A, flows around the body of valve spool 102 in compartment 112 and exits compartment 112 at port B to be led by suitable ducting 134 to port X of central cylindrical actuating chamber 28 of pumping module 20. Ducting 134 branches to also lead to port H and port D of valve chamber 104. When the valve body 102 is in the position illustrated in FIG. 3, port H leads into the valve chamber clear of valve spool body 102 at one end 105 thereof and port D leads into narrow passage 118 at the other end thereof and registers with communicating channel 148 which itself communicates with valve chamber 104 at another end 107 of the valve spool 102.

Compressed air entering the actuating chamber 28 of pumping module 20 at port X acts to move piston portion 34 in the chamber 28 to move past port W and thereby open a passage for compressed air within chamber 28 between port X and port W. Compressed air will therefore flow out from chamber 28 through port W and is led by suitable ducting 136 into pilot chamber 122 of valve 100 at port G to maintain pilot in position shown in FIG. 3 with its leg 130 located in narrow passage 118. As this happens air is also expressed from actuating chamber 28 of pumping module 20 via port Y to vent via port C of valve 100, compartment 114 and exhaust port 148.

As piston portion 34 moves further along chamber 28 towards the end of its stroke communication will also be opened between port X and port V.

Port V communicates with port F of valve 100 through suitable ducting 140. When communication between port X and port V is opened pressure of the compressed air acts on pilot valve disc 128 to move it so that its axial stem 132 moves further into narrow passage 120 from the position shown in FIG. 3. Stem 132 contains a communication channel 144 which moves into register with port E of valve 100 communicating port E with end 105 of valve chamber 104 which is already receiving compressed air pressure through port H. When port H communicates with port E, release of pressure from end 105 of chamber 104 is possible through port E via a branch of suitable ducting 146 leading to port C of valve 100 and thence to exhaust vent 148. The result is an imbalance of pressure between the end of valve spool 102. Thus, compressed air pressure entering valve 100 through port D and communicating through communication channel 148 with end 107 by valve chamber 104 acts to move the valve spool 102 leftwards out of the position shown in FIG. 3 towards valve disc 128.

Figure 3:
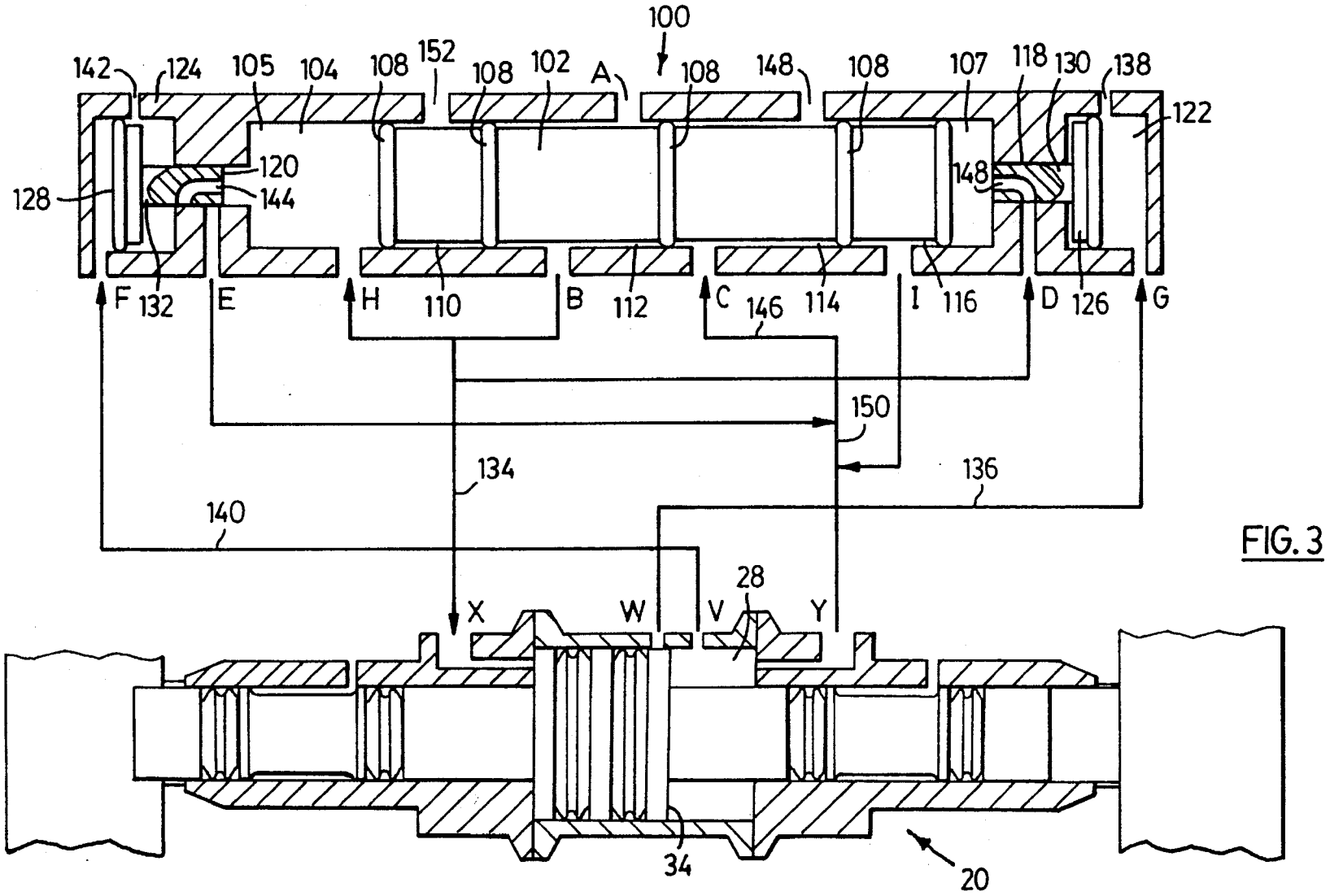
FIG. 3 shows a valve suitable for operating the pneumatically operated piston of the apparatus of FIGS. 1.

As valve spool 102 moves towards the left of FIG. 3, i.e. towards valve disc 128, compartment 112 moves out of register with port A and compartment 114 moves into register with port A and out of register with exhaust port 149.

As compartment 114 moves into register with input port A, air pressure is transmitted from port C of valve 100 via suitable ducting 150 to port Y of central cylindrical actuating chamber 28 of pumping module 20. Port B of compartment 112 now exhausts to exhaust port 152 to exhaust pressure from port X of chamber 28 of pumping module 20 through ducting 134.

When pressure is relieved from port D through the branch of ducting 134, it is possible for pressure now exerted through port C through ducting 150 and port I to act on pilot valve disc 126 through its stem 130 to move it to the right in pilot chamber 122. Port D is now blind as valve disc 126 moves to the right to withdraw communication channel 148 from register with port D.

This cycle is repeated to reciprocate piston part 34 in pump chamber 28.

By suitable choice of location for ports V and W of pumping module 20 fine control may be exerted on reciprocation of piston part 34. If port V is so located that communication is not established with port X and hence with pilot valve chamber 124 until the end of the stroke of piston part 34 valve 100 will not act to change the direction of pressure on valve spool 102 until that point is reached. Thus the stroke of a similar state of affairs exists for communication between port W and port Y.

We claim:

1. A pneumatically operated double acting pump assembly for pumping viscous fluids, comprising:

a piston having a central cylindrical actuating portion of one diameter integral with first and second cylindrical piston end portions of another diameter, said one diameter being larger than said other diameter;

a piston chamber in which a piston unit is reciprocable under pneumatic pressure, the piston chamber comprising a central actuating chamber accommodating the actuating portion, the central actuating chamber including a stop at either end to limit the stroke of the actuating portion, the piston chamber also including end chambers each opening at a proximal end from the actuation chamber to either side to accommodate the respective first and second cylindrical end portions; and each of the said end chambers opening at a distal end into a respective one of first and second pumping conduits for viscous fluids downstream of a first non-return valve and upstream of a second non-return valve;

a pair of spaced apart seals around each piston end portion to seal with an inner wall of the respective end chamber to prevent leakage of fluid therepast, the seals enclosing an intermediate region between a wall of the end portion and a wall of the chamber; and inspection means accessing the intermediate region.

2. A pneumatically operated double acting pump assembly as claimed in claim 1 in which each seal is a double seal.

3. A modular pneumatically operated double acting pump assembly for pumping viscous fluids, comprising:

a first module comprising:

a piston having a central cylindrical actuating portion of one diameter integral with first and second cylindrical end portions of another diameter, said one diameter being larger than said other diameter;

a piston chamber in which a piston unit is reciprocable under pneumatic pressure, the piston chamber comprising a central actuating chamber accommodating the actuating portion, the central actuating chamber including a stop at either end to limit the stroke of the actuating portion, the piston chamber also including end chambers each continuous with and opening at a proximal end from the actuation chamber to either side to accommodate the respective first and second cylindrical end portions; and each of the said end chambers opening at a distal end, into, at a T-junction, respective-open ended first and second cylindrical sections each of which is continuous with and opening into respective ones of first and second pumping conduits for viscous fluids downstream of a first non-return valve and upstream of a second non-return valve;

the piston having a pair of spaced apart seals around each piston end portion to seal with an inner wall of the respective end chamber to prevent leakage of fluid therepast, the seals enclosing an intermediate region between a wall of the end portion and a wall of the chamber;

four further modules, each further module comprising a further section of pumping conduit having said similar conduit diameter and each further module being connected for liquid flow therethrough to an end of one of said first and second sections whereby inner walls of two of said further modules and said first section are smoothly continuous and inner walls of another two of said further modules and said second section are continuous; and said further modules including non-return valves for flow of liquid in one direction.

4. A modular pneumatically operated double acting pump assembly as claimed in claim 3 in which the piston chamber comprises submodules for the central actuating chamber and for each of the first and second cylindrical end chambers, and for the T-junctions.

5. A modular pneumatically operated double acting pump assembly as claimed in claim 4 in which each module and submodule includes outwardly extending radial flanges at each end thereof, flanges of one module abutting against flanges of an adjacent module, and in which a band clamp is provided about each pair of adjacent flanges clamping them together.

6. A modular pneumatically operated pump assemble as claimed in claim 5 in which each band clamp is manually tightenable and releasable.

7. A pneumatically operated double acting pump assembly as claimed in claim 1 in which said piston is reciprocable in a piston chamber by means of a reciprocable spool valve:

the piston chamber having one port at one end to receive/exhaust pressure and a another port at another end to exhaust/receive pressure, and the piston chamber having and first and second control ports;

the reciprocable spool valve having a spool reciprocable in a valve chamber between a first valve position to deliver pressure to said one port and exhaust pressure from said other port and a second valve position to deliver pressure to said other port and exhaust pressure from said one port; and first and second pilot chambers communicating respectively with ends of the valve chambers, first and second pilot pistons, the first pilot piston being reciprocable in the first pilot chamber between a first pilot position and a second pilot position and the second pilot piston being reciprocable in the second pilot chamber between another first pilot position and another second pilot position by receipt/exhaust of pressure from one of said first and second control ports;

each piston in its first pilot position acting to deliver/exhaust pressure to/from one of the ends of the valve chamber;

the first and second control ports being located in the piston chamber to deliver pressure to the first and second pilot chambers whereby the first pilot piston is in its first pilot position when the second pilot piston is in its second pilot position and vice versa.

8. An assembly as claimed in claim 7 in which the first and second control ports are located such that pressure from one of the first and second control ports is transmitted to one side of one of the first and second pilot pistons when the central actuating portion of the pump assembly is nearing the end of its stroke to bias said one of the first and second pilot pistons into its first pilot position to allow pressure delivery to an adjacent one end of the valve chamber; and such that pressure from another of the first and second control ports is transmitted to a similar one side of the other one of the first and second pilot pistons when the central cylindrical actuating portion of the pump assembly is at the end of its stroke to move said other one of the first and second ones of said pilot pistons into its first position to vent pressure from an adjacent other end of the valve chamber.

9. An assembly as claimed in claim 8 in which venting of pressure from said adjacent other end of the valve chamber allows the spool to move into a position to deliver pressure to said one end of the valve chamber and thereby move said one of said first and second pilot pistons into its second pilot position.

10. An assembly as claimed in claim 9 in which each of the first and second pilot pistons is a disc piston having a axial stem extending into and sliding in a channel between the valve chamber and the respective pilot chamber.

11. An assembly as claimed in claim 10 in which the axial stem contains a communication channel opening, on the one hand, into a respective one of the valve chamber ends and, on the other hand into the channel between the valve chamber and the respective pilot chamber.

12. An assembly as claimed in claim 11 in which the communication channel registers with a port for the receipt/exhaust of pressure when the pilot piston is in said one position.

* * * * *